United States Patent [19]

Vargo, Jr.

[11] 4,315,605

[45] Feb. 16, 1982

[54] HAMMER MILL ROTOR

[75] Inventor: John V. Vargo, Jr., Muncy, Pa.

[73] Assignee: Koppers Company, Inc., Pittsburgh, Pa.

[21] Appl. No.: 93,805

[22] Filed: Nov. 13, 1979

[51] Int. Cl.[3] ..... B02C 13/02

[52] U.S. Cl. ..... 241/192; 241/195

[58] Field of Search ..... 241/191, 192, 193, 194, 241/195, 196

[56] References Cited

U.S. PATENT DOCUMENTS

| | | | |
|---|---|---|---|
| 791,328 | 5/1905 | Davenport | 241/191 |
| 1,615,134 | 1/1927 | Price | 241/191 |
| 2,448,849 | 9/1948 | Wagner et al. | 241/191 |
| 2,531,732 | 11/1950 | Hoffman | 241/194 |
| 3,254,687 | 6/1966 | Tertyshnikov | 241/191 |
| 3,824,777 | 7/1974 | Riggs | 57/217 |

*Primary Examiner*—John McQuade
*Attorney, Agent, or Firm*—Thomas F. Shanahan; Herbert J. Zeh; Oscar B. Brumback

[57] ABSTRACT

A rotor for a hammer mill and the like comprising a rotor body and a hammer secured to said rotor body, said hammer being comprised essentially of flexible wire rope.

4 Claims, 4 Drawing Figures

HAMMER MILL ROTOR

BACKGROUND OF THE INVENTION

1. Field of the Invention

This invention relates to a rotor for a hammer mill and the like and, more particularly, to a hammer for a hammer mill used to grind, shred or fluff various materials such as cereal grains, tobacco and wood pulp.

2. Description of the Prior Art

In the grinding of cereal grains, for example, in a hammer mill, the primary grinding takes place when the grain is driven against a breaker plate. The grain is actually caused to be driven against the breaker plate by means of the rotating hammers. The hammers also drive the grain against a screen where the final reduction takes place through the striking of the grain by the hammers. The size of the reduced grain which is discharged from the mill is determined by the diameter of the perforations in the screen.

In prior art hammer mills, the hammers were generally rigid, metallic members of various fixed shapes which were detachably secured to a rotor or the like. In one particular known construction, in addition to a rotor shaft, hammers and bearings, the rotor structure also included retainer discs, hinge pins, spacers and collars. These additional members not only added to the expense and complexity of the structure but, in particular, it is known that the $WK^2$ (mass moment of inertia times the acceleration of gravity) of the structure was relatively high and, therefore energy consuming. Also, it is known that energy losses due to friction generally and, in particular, to air pumping by the retainer discs was inherent in this type of structure. Moreover, it was frequently necessary when changing to a different feed stock, to replace all the hammers with hammers of a particular shape or design suitable for the stock being worked on and having a length giving a particularly desired hammer to screen clearance. It is, accordingly, a desideratum of this invention to eliminate or substantially reduce the foregoing constraints of the prior art structure.

SUMMARY OF THE INVENTION

In accordance with the present invention, there is provided a novel hammer for a hammer mill and, in particular, a novel hammer mill rotor that efficiently accomplishes the foregoing objectives. More specifically, there is provided a rotor for a hammer mill and the like comprising a rotor body having a flexible, wire rope hammer secured to the rotor body. The novel hammer of this invention may include a polymeric jacketing material, may be releasably secured to the rotor body by either an integral attachment device or a separable attachment device, may be terminated with a replaceable, enlarged hammer tip and may be adjusted in length to permit varying at will the hammer to screen clearance.

DESCRIPTION OF THE PREFERRED EMBODIMENTS

Figure 1:
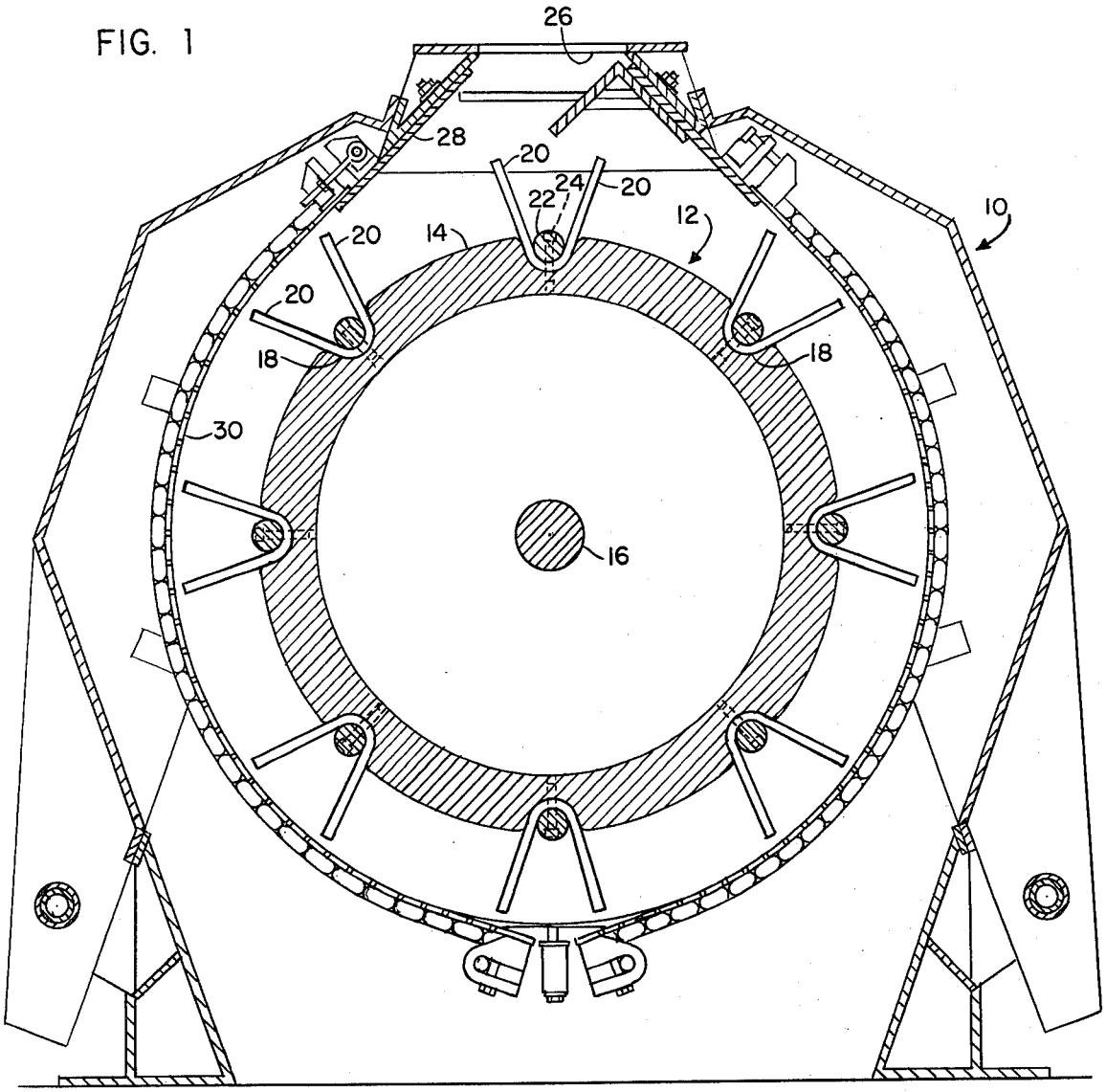
FIG. 1 is an elevational view, partly in section, of a hammer mill incorporating the hammer and rotor structure of this invention.

Referring to FIG. 1, there is shown a hammer mill, generally designated at 10, incorporating the novel hammer mill rotor, generally designated at 12, of this invention. Rotor body 14 is mounted on a shaft 16 through which it is rotated by a conventional electric motor, not shown. As will be understood, in the embodiment shown, rotor body 14 is an elongated cylindrical member, closed at both ends, with the ends containing a suitable central aperture to receive shaft 16. Also, as illustrated, disposed about the perimeter of rotor body 14 and suitably formed therein are elongated slots 18 into which are received the flexible wire rope hammers 20 of this invention. Securing hammers 20 to rotor body 14 are elongated bars 22 suitably affixed to rotor body 14 as by means of threaded bolts 24. Generally, in addition to hammers 20 being disposed around the periphery of rotor body 14, a plurality of such hammers are also longitudinally aligned along the length of rotor body 14 in grooves or slots 18. In a typical mill, sixty-four hammers are used for fine grinding while thirty-two are used in course grinding operations.

The material to be reduced is introduced into the mill 10 through inlet 26 by conventional material handling equipment, not shown. Breaker plate 28 is mounted across inlet 26 so that the material to be reduced is forced to strike the plate to accomplish the first size reduction. Material is caused to be carried through the mill 10 by means of a conventional air intake system, not shown. After contacting the breaker plate the material enters the interior of the mill where final size reduction is accomplished. Mounted outside the radial reach of the hammers is hammer mill screen 30. Hammers 20 drive the material against screen 30 causing the final size reduction. The final size of the material is determined by the diameter of the perforations in screen 30. When the material is reduced to the size of the perforations, it is discharged from the mill through screen 30 and is collected by conventional material handling equipment, not shown.

The flexible wire rope preferred for use with this invention is generally of a diameter of about five-sixteenths to three-eighths of an inch. In any event, it is generally preferred that the flexible wire rope used does not exceed about one-half inch in diameter. Also in certain instances it is preferred that the flexible wire rope be coated or jacketed with a plastic or polymeric material, such as nylon, polyurethane and the like. Coated wire rope of this nature is commercially available from virtually every wire rope manufacturer. Generally, coated wire rope is preferred where the material worked on would tend to adhere to the hammer and, in addition, should reduce frictional losses caused by rapid rotary movement of the hammers within the hammer mill.

Figure 2:
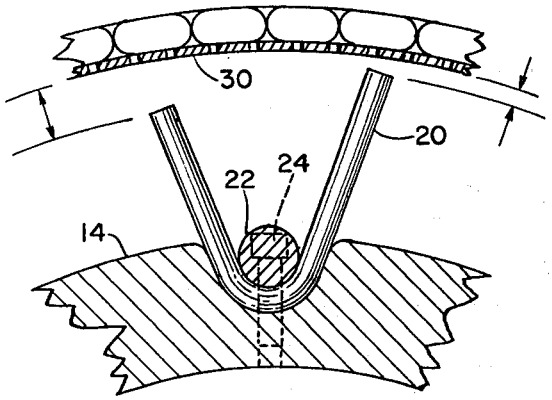
FIG. 2 is an enlarged, fragmentary, sectional view of one embodiment of the invention.

Shown in FIG. 1 are flexible wire rope hammers that are snubbed centrally of the length of the wire rope, to rotor body 14, by releasable, elongated attachment bars 22. In this embodiment, both ends of the wire rope act as hammers and both ends are equally spaced from the hammer mill screen 30. Obviously, however, if it is desired, it is also possible to snub one end of a shorter length of wire rope than shown, under attachment means 22, such that a single hammer is in each instance presented to screen 30. Moreover, as shown in FIG. 2, the hammer to screen spacing or clearance can be varied or changed by the mere act of securing or snubbing a length of wire rope, such as illustrated in FIG. 1, at a location removed from the precise center of its length.

Figure 3:
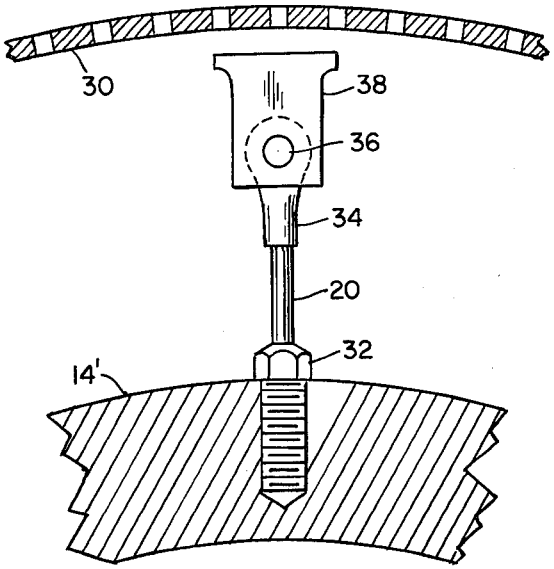
FIG. 3 is an enlarged, fragmentary, sectional view of another embodiment of the invention.

Illustrated in FIG. 3 is another embodiment of this invention. In this particular embodiment, the flexible wire rope hammer 20 is terminated on one end with a swaged, threaded, attachment member 32 and on the other end with a swaged, cable eye 34. Releasably secured to cable eye 34 by means of a suitable pin 36 is an enlarged hammer tip 38. Obviously, in an arrangement such as shown in FIG. 3, a tip of a different design or shape than shown could be substituted for the illustrated tip 38. Also, it will be obvious that the entire hammer assembly of FIG. 3 can be threadedly detached from rotor body 14' and replaced with an entirely different threadedly attachable hammer assembly.

Figure 4:
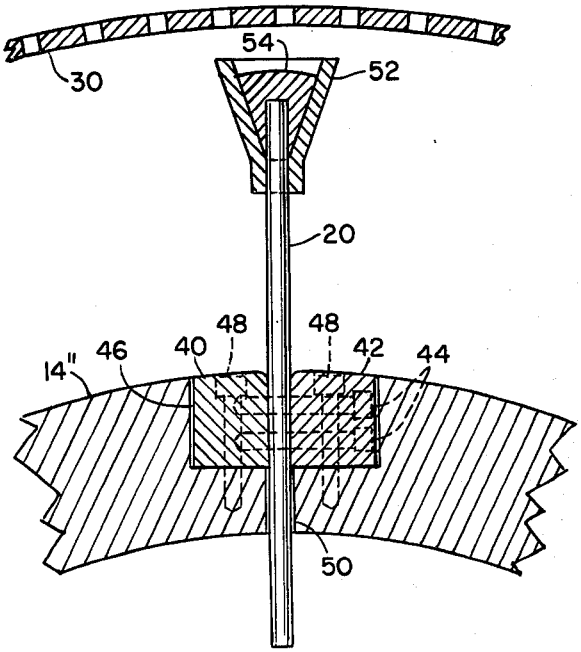
FIG. 4 is an enlarged, fragmentary, sectional view of a third embodiment of the invention.

Similarly, illustrated in FIG. 4 is a third embodiment of the invention. In this embodiment, a plurality of flexible wire rope hammers 20 can be preassembled on a work bench and ready for installation when needed. By reason of clamping the wire rope hammers 20 (one of which is shown) between a pair of elongated bars 40 and 42, with bolts 44, preassembly is possible as is also possible the presetting of the hammer to screen clearance for optimum grinding. The hammers and clamping device can then be threadedly attached to a suitable elongated slot 46 in the periphery of rotor body 14" by means of bolts 48. Moreover, suitable bores or apertures 50 can be formed in the bottom of slot 46 to receive extended portions of hammer 20. As is also shown in FIG. 4, a generally annular frusto conical hammer tip 52 is releasably secured to the operating end of hammers 20 by means of an oppositely disposed frusto conical stop member 54 swaged on said end. As will be understood, upon removal of a hammer 20 from its clamping device, the hammer tip 52 can be slid off of the thus presented free end and, if desired, replaced with a different tip.

Although the present invention has been shown and described in connection with particular embodiments thereof, it will be understood that it may otherwise be embodied within the scope of the following claims.

What is claimed is:

1. A rotor for hammer mills comprising a rotor body and a hammer secured to said rotor body, said hammer releasably and adjustably secured to said body by a separable attachment device and said hammer being comprised essentially of flexible wire rope.

2. The rotor of claim 1 wherein said flexible wire rope includes a polymeric jacketing material.

3. The rotor of claim 2 wherein said polymeric jacketing material comprises a nylon material.

4. The rotor of claim 2 wherein said polymeric jacketing material comprises a polyurethane material.

* * * * *